US011017939B2

(12) United States Patent
Krishnamoorthy et al.

(10) Patent No.: US 11,017,939 B2
(45) Date of Patent: May 25, 2021

(54) MAGNETIC COMPONENT ASSEMBLY WITH FILLED GAP

(71) Applicant: EATON INTELLIGENT POWER LIMITED, Dublin (IE)

(72) Inventors: Ahila Krishnamoorthy, Danville, CA (US); Robert James Bogert, Lake Worth, FL (US); Yipeng Yan, Shanghai (CN)

(73) Assignee: EATON INTELLIGENT POWER LIMITED, Dublin (IE)

( * ) Notice: Subject to any disclaimer, the term of this patent is extended or adjusted under 35 U.S.C. 154(b) by 50 days.

(21) Appl. No.: 14/146,973

(22) Filed: Jan. 3, 2014

(65) Prior Publication Data

US 2014/0266555 A1 Sep. 18, 2014

Related U.S. Application Data

(60) Provisional application No. 61/787,950, filed on Mar. 15, 2013.

(51) Int. Cl.

| | |
|---|---|
| ***H01F 27/24*** | (2006.01) |
| ***H01F 27/29*** | (2006.01) |
| ***H01F 3/14*** | (2006.01) |
| ***H01F 17/04*** | (2006.01) |
| ***H01F 27/255*** | (2006.01) |

(Continued)

(52) U.S. Cl.

CPC ..... *H01F 27/292* (2013.01); *H01F 3/10* (2013.01); *H01F 3/14* (2013.01); *H01F 17/04* (2013.01); *H01F 27/24* (2013.01); *H01F 27/255* (2013.01); *H01F 27/2847* (2013.01); *H01F 27/29* (2013.01); *H01F 27/306* (2013.01); *H01F 2003/106* (2013.01); *H01F 2017/048* (2013.01)

(58) Field of Classification Search

CPC .... H01F 5/00; H01F 27/00–30; H01F 27/292; H01F 27/24; H01F 27/29; H01F 3/14; H01F 17/04; H01F 27/255; H01F 27/2847; H01F 27/306; H01F 3/10; H01F 2003/106; H01F 2017/048

USPC ..... 336/65, 83, 178, 200, 232, 192

See application file for complete search history.

(56) References Cited

U.S. PATENT DOCUMENTS 4,769,900 A 9/1988 Morinaga et al.
5,680,087 A * 10/1997 Sakata ..... H01F 27/292 336/192

(Continued)

FOREIGN PATENT DOCUMENTS

| | | |
|---|---|---|
| JP | 2001052934 A | 2/2001 |
| JP | 2013-51399 A | 3/2013 |
| TW | 434594 B | 5/2001 |

OTHER PUBLICATIONS

International Search Report and Written Opinion of International Application No. PCT/US2014/024689; dated Jun. 26, 2014; 13 pages.

(Continued)

*Primary Examiner* — Tuyen T Nguyen
(74) *Attorney, Agent, or Firm* — Armstrong Teasdale LLP

(57) ABSTRACT

Magnetic component assemblies for circuit boards include magnetic cores formed with a gap and preformed conductive windings sliding assembled to the cores via the gaps. The gaps in the cores are filled with a magnetic material to enhance the magnetic performance. The magnetic component assemblies may define power inductors.

40 Claims, 3 Drawing Sheets

(51) Int. Cl.

| | |
|---|---|
| ***H01F 27/28*** | (2006.01) |
| ***H01F 27/30*** | (2006.01) |
| ***H01F 3/10*** | (2006.01) |

(56) References Cited

U.S. PATENT DOCUMENTS 6,356,179 B1 3/2002 Yamada
6,392,525 B1 * 5/2002 Kato ..... H01F 3/08 336/200
7,623,014 B2 * 11/2009 Hsieh ..... H01F 17/045 336/185
8,279,037 B2 * 10/2012 Yan ..... H01F 3/14 336/233
8,310,332 B2 * 11/2012 Yan ..... H01F 1/15358 336/192
8,438,720 B2 * 5/2013 Muneuchi ..... H01F 17/045 29/602.1
2003/0227366 A1 12/2003 Lin
2008/0055034 A1 3/2008 Tsunemi et al.
2008/0252406 A1 * 10/2008 Kitajima ..... H01F 17/045 336/83
2010/0007453 A1 * 1/2010 Yan ..... H01F 27/027 336/90
2010/0013587 A1 1/2010 Yan et al.
2010/0148902 A1 6/2010 Shin et al.
2010/0253456 A1 10/2010 Yan et al.

OTHER PUBLICATIONS

SMT Power Inductors—SLC7530 Series; Document 366-1; © Coilcraft, Inc. 2007; 3 pages.
SMT Power Inductors—SLC7649 Series; Document 481-1; © Coilcraft, Inc. 2007; 2 pages.
SMT Power Inductors—SLC1049 Series; Document 498-1; © Coilcraft, Inc. 2007; 2 pages.

* cited by examiner

MAGNETIC COMPONENT ASSEMBLY WITH FILLED GAP

CROSS REFERENCE TO RELATED APPLICATIONS

This application claims the benefit of U.S. Provisional Application Ser. No. 61/787,950 filed Mar. 15, 2013, the complete disclosure of which is hereby incorporated by reference in its entirety.

BACKGROUND OF THE INVENTION

The field of the invention relates generally to magnetic components for circuit boards and related manufacturing methods, and more specifically to surface mount magnetic components such as power inductors having shaped magnetic cores and preformed conductive windings exposed on the side walls and on the bottom of the magnetic cores.

Power inductors are used in power supply management applications and power management circuitry on circuit boards for powering a host of electronic devices, including but not necessarily limited to hand held electronic devices. Power inductors are designed to induce magnetic fields via current flowing through one or more conductive windings, and store energy via the generation of magnetic fields in magnetic cores associated with the windings. Power inductors also return the stored energy to the associated electrical circuit as the current through the winding falls and may provide regulated power from rapidly switching power supplies.

In order to meet increasing demand for electronic devices, especially hand held devices, each generation of electronic devices needs to be not only smaller, but offer increased functional features and capabilities. As a result, the electronic devices tend to be increasingly powerful devices in smaller and smaller physical packages. Meeting increased power demands of ever more powerful electronic devices while continuing to reduce the size of circuit boards and components such as power inductors that are already quite small, has proven challenging. Improvements are desired.

BRIEF DESCRIPTION OF THE DRAWINGS

Non-limiting and non-exhaustive embodiments are described with reference to the following Figures, wherein like reference numerals refer to like parts throughout the various drawings unless otherwise specified.

DETAILED DESCRIPTION OF THE INVENTION

Figure 1:
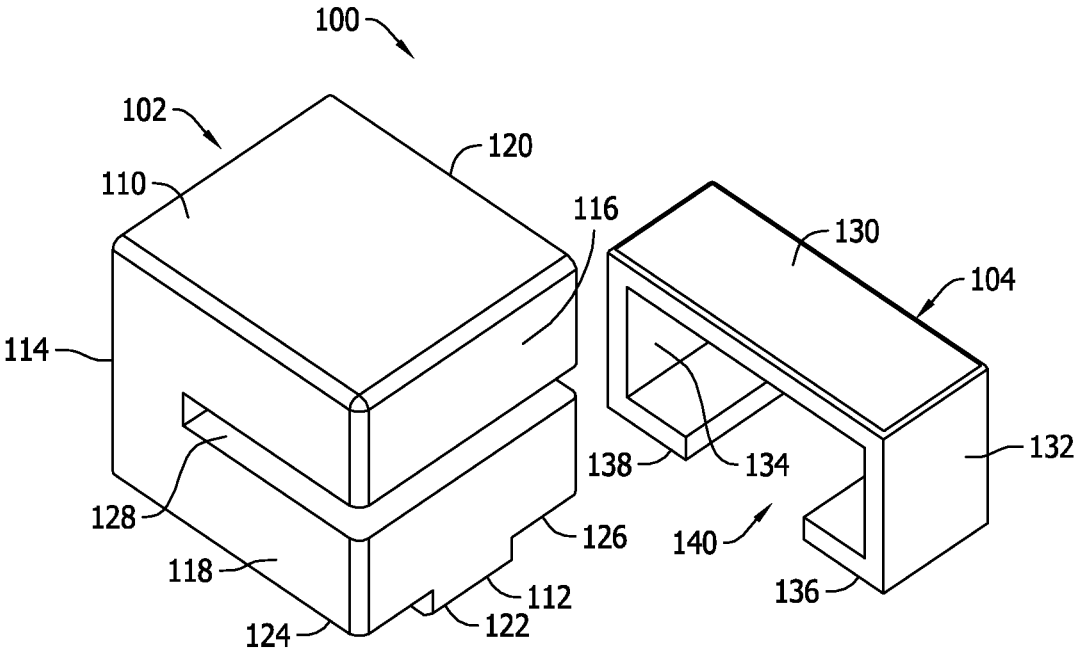
FIG. 1 is an assembly view of a first exemplary embodiment of a surface mount magnetic component at a first stage of manufacture.

In order to provide increasingly powerful electronic devices having an ever expanding number of features and capabilities, the power inductors used in the power management circuitry in general must operate at higher levels of current and power as the devices operate. Known techniques to manufacture miniaturized power inductors for circuit board applications are, however, disadvantaged in some aspects for higher current applications.

Laminated power inductor products are known having a number of magnetic layers or substrates upon which planar portions of a conductive winding may be formed. When the planar winding portions of the various layers are connected with one another, a larger conductive coil is completed amongst the various layers in the device. Forming fine conductive windings on the surfaces of magnetic substrates and the like using printing techniques, deposition techniques, or lithography techniques can successfully provide extremely small components. However, such windings formed by such techniques are limited in their ability to function at high current, high power levels, let alone provide desired performance for certain applications.

In lieu of forming conductive windings on the surfaces of magnetic substrates and the like, shaped magnetic cores are sometimes used in combination with separately fabricated, freestanding conductor elements that are shaped or bent into the final form of a conductive winding as the power inductor is manufactured. In many instances, such freestanding conductor elements are shaped or bent around one or more surfaces of the magnetic core pieces utilized. Specifically, in such embodiments, the conductor is extended through a through-hole formed in the magnetic body, and one or both ends of the conductor is typically bent around opposing side wall edges of the magnetic core to form surface mount terminals for the power inductor to be terminated to corresponding circuit mount pads on a circuit board.

Because the shaped magnetic core pieces are relatively small, however, they are also relatively fragile. Conventional bending or shaping the freestanding conductor around the core piece can be problematic if the magnetic core piece or the conductor is damaged during manufacture of the component. Of course, increasing the cross sectional area of the conductor utilized to fabricate the winding results in a stiffer conductor that is more difficult to bend, and hence only increases the difficulty of manufacturing power inductors without cracking or otherwise damaging the magnetic core pieces. Damage to the core pieces, which may be difficult to control or detect, can lead to considerable performance fluctuation in the manufactured power inductors that is inherently undesirable. Still further, thicker and stiffer conductor elements that are desirable in high current applications, present further difficulties in providing completely flat surface mount terminals when bending the conductor around the core. If the surface mount terminals are not flat, the mechanical and electrical connections when the device is mounted to a circuit board is likely to be compromised.

More recently, it has been proposed to use so-called preformed conductive windings that are separately fabricated from magnetic cores and are entirely shaped in advance to include the surface mount terminal pads needed to connect the winding to a circuit board. Such preformed conductive windings may have a C-shaped clip configuration that may be slidingly assembled to magnetic core pieces without bending or shaping any portion of the winding over the magnetic core pieces utilized.

In certain types of devices, monolithic magnetic core pieces are provided from compressed magnetic powder materials via molding techniques, and one or more non-magnetic gaps are provided in the body. Typically, in a molded magnetic powder construction of a shaped core, the non-magnetic gaps are simply air gaps in the core construction. While such air gap constructions are satisfactory for many applications, there are performance limits of such a power inductor construction, and improvements are desired.

A power inductor manufacture is desired to provide surface mount power inductor components that may operate at higher currents with improved magnetic performance. Accordingly, exemplary embodiments of surface mount power inductor components are described below that offer performance improvements. Method aspects will be in part apparent and in part explicitly discussed in the following description in which the benefits and advantages of the inventive concepts will be demonstrated.

FIG. 1 illustrates a first exemplary embodiment of a magnetic component construction 100 at a first stage of manufacture. As seen in FIG. 1, the component 100 includes a single piece, preformed magnetic core 102 and a preformed conductive winding 104.

The magnetic core 102 in the example of FIG. 1 includes a generally rectangular body having orthogonal walls including opposing top and bottom side walls 110, 112, opposing lateral side walls 114, 116 interconnecting the top and bottom side walls 110, 112, and opposing longitudinal side walls 118, 120 interconnecting the top and bottom side walls 110, 112 and the lateral side walls 114, 116. The bottom side wall 112 is formed with a projecting guide surface 122 extending longitudinally between the lateral side walls 114, 116 and recessed side wall edges 124, 126 extending on either side wall of the guide surface 122. The remaining side walls 110, 114, 116, 118 and 120 are generally flat and planar in the exemplary embodiment shown.

The magnetic core 102 is further formed with a gap 128 that extends to and through the lateral side wall 116 and to and through portions of the longitudinal side walls 118, 120. As such, the gap 128 is open at the core side wall 116 and also is open at portions of the core side walls 118, 120. The gap 128 extends generally parallel to the flat and planar top side wall 110, but is spaced from the top side wall 110. In the example shown, the gap 128 extends generally centrally in the core 102 and is about equidistant from the top and bottom side walls 110, 112. The gap 128 does not extend, however, to the lateral side wall 114. In other words, the gap 128 extends only partially between the side walls 114 and 116. Rather, the lateral side wall 114 is solid and has no openings formed therein. The gap 128 is also formed with a constant thickness t (FIG. 2) measured in a direction perpendicular to the plane of the top side wall 110 and parallel to the plane of the side walls 114, 116, 118 and 120.

The preformed conductive winding 104 is formed from a conductive material and generally includes a flat and planar main winding section 130, opposing terminal sections 132, 134 extending generally perpendicular to the plane of the main winding section 130, and surface mount terminal sections 136, 138 extending inwardly from the terminal sections 132, 134 in a spaced relation from, but generally parallel to, the main winding section 130. A gap 140 extends between the distal ends of the surface mount terminal sections 136, 138. The thickness of the main winding section 130 is about equal to and slightly less than the thickness t (FIG. 2) of the gap 128 formed in the core 102. The winding 104 is fabricated as a separately provided part from the core 102 and is provided as a freestanding structure for assembly with the core 102 as described below.

Figure 2:
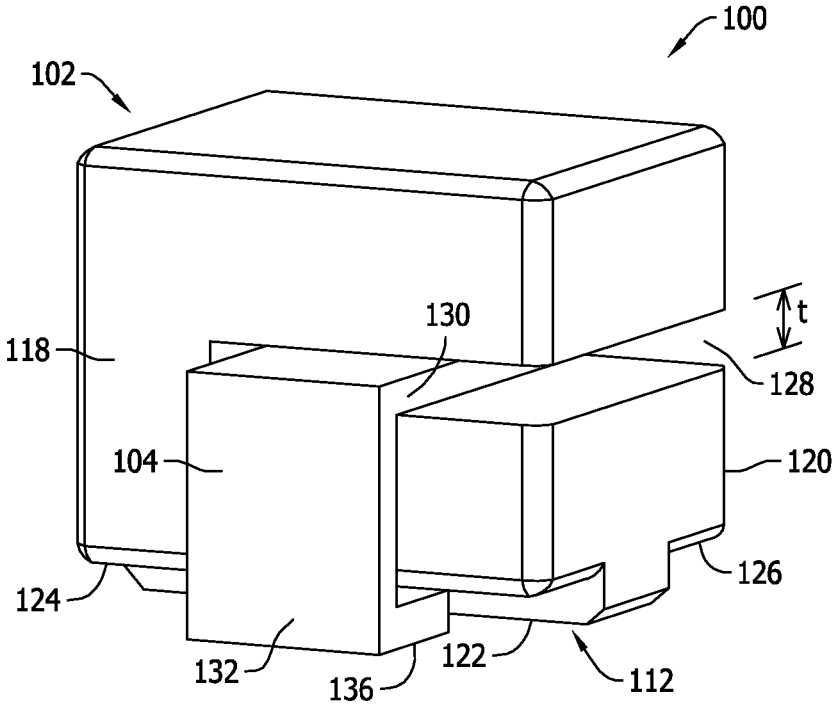
FIG. 2 is a side perspective view of the surface mount magnetic component shown in FIG. 1 at a first stage of manufacture.

As shown in FIG. 2, the preformed conductive winding 104 is assembled to the core 102 by inserting the main winding section 130 of the preformed winding 104 in the core gap 128 with the terminal sections 132, 134 extending alongside the core side walls 118 and 120 and the surface mount terminal sections 136, 138 extending along the recessed side wall sections 124, 126 of the bottom wall 112 on either side wall of the guide surface 122, which in turn is received in the winding gap 140 (FIG. 1). The cross sectional area of the core 102 below the core gap 128 has a T-shape that inter-fits with a complementary interior opening of the preformed winding 104. The winding 104 may therefore be slidingly assembled with the core 102 as shown in FIGS. 1 and 2 until the main winding section 130 reaches the end of the gap 128. Such sliding assembly of a preformed winding 104 to the core 102, which is facilitated by the uniform thickness of the gap 128 formed in the core 102, beneficially avoids more complicated manufacturing steps, and also associated issues discussed above relating to insertion of a conductor through a through-hole and bending the ends of the conductor around the side walls of the core to complete the surface mount terminations.

Figure 3:
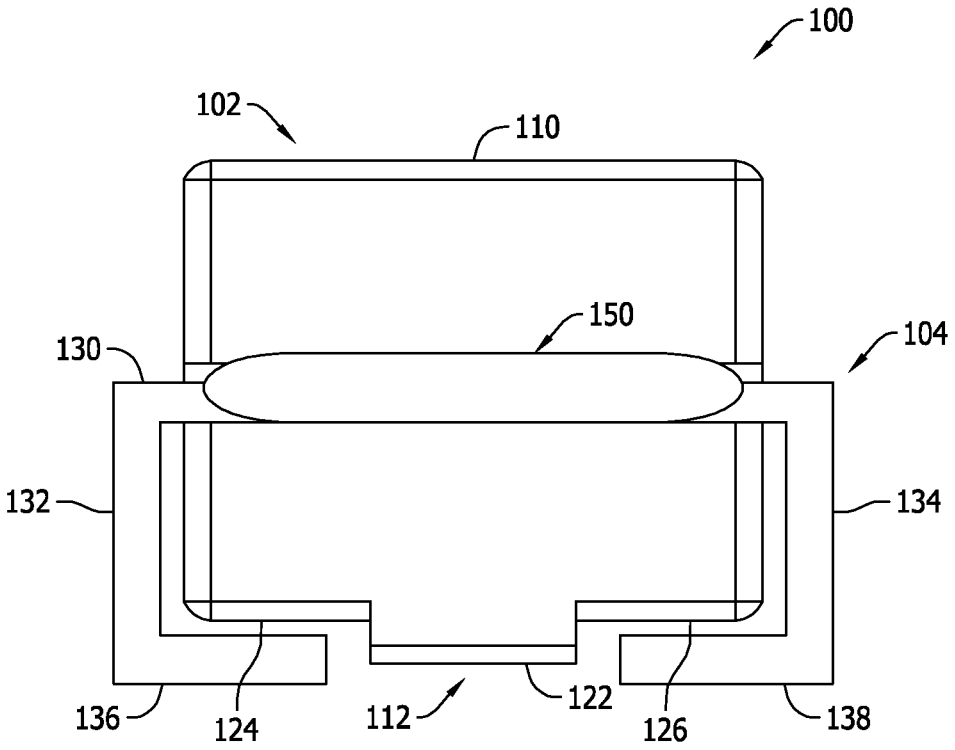
FIG. 3 is an end elevational view of the surface mount magnetic component shown in FIG. 1 at a second stage of manufacture.

As shown in FIG. 3, after assembly of the preformed winding 104, the gap 128 in the core 102 is filled with a magnetic material 150 to provide enhanced magnetic performance. When filled with a magnetic material 150, the gap 128, which otherwise would be non-magnetic, becomes a magnetic gap that provides for improved magnetic performance of the device 100.

Filling the gap 128 with magnetic material 150 of a strategically selected magnetic permeability may achieve optimal performance of the component 100. More specifically, the component 100, by virtue of the magnetic material 150, may operate with a reduced fringing loss when operating with a given current level as compared to conventional power inductor constructions where the gap 128 is non-magnetic. The selection of the magnetic material 150 may be further coordinated with the magnetic material used to fabricate the core 102.

In one embodiment, the core 102 may be fabricated from a ferrite material while the magnetic material 150 is a non-ferrite material. Due to the differences in magnetic properties of ferrite and non-ferrite magnetic materials, fringing losses may be considerably reduced using a combination of materials to fabricate the core 102 and to fill the gap 128.

In a further embodiment, ferrite particles may be ground to a fine powder and mixed with polymer to form distributed gap ferrite material that may be shaped into the core 102. A non-ferrite magnetic material, such as iron based alloys or other magnetic material, may be mixed with polymer and formed into a distributed gap material that may be utilized as the magnetic material 150 to fill the gap 128.

In another embodiment, non-ferrite but nonetheless magnetic particles such as iron based alloys or other magnetic material, may be mixed with polymer and formed into a distributed gap material that may be shaped into the core 102. Ferrite particles may be ground to a fine powder and mixed with polymer to form distributed gap ferrite material that may be utilized as the magnetic material 150 to fill the gap 128.

In still other embodiments, the magnetic material utilized to form the body 102 and the material 150 utilized to fill the gap 128 may each be ferrite or non-ferrite magnetic materials, so long as the magnetic material utilized to form the body 102 and the material 150 utilized to fill the gap 128 possess different magnetic properties.

In each case, magnetic powder materials are selected in view of the desired performance metrics, including but not necessarily limited to initial magnetic permeability ($\mu_i$) saturation magnetization ($B_{sat}$), and frequency dependence. The selected magnetic materials are mixed with polymers to form a powder-polymer mixture. The composition of this mixture may be chosen for desired inductance and fringing loss performance.

For purposes of the magnetic material 150 to fill the gap 128, this mixture may be provided in either powder or ribbon form and filled/placed in the gap 128 of the core 102 that is fabricated from another magnetic material with different properties.

With the preformed winding 104 in place as shown in FIG. 2, the gap 128 is filled with the magnetic material 150 and the entire assembly is held in position and annealed at the cure temperature of the polymer utilized. For example epoxy polymer resins are cured at 160° C. whereas an EPDM type of rubber polymer may be cured at 200° C. The curing process seals the gap 128 with the magnetic material 150.

While the example shown in FIGS. 1-3 includes a single gap 128, additional gaps may be provided at other locations in the core 102 and also may be filled with the magnetic material 150 to provide components having enhanced magnetic performance. In particular, dual gaps may be provided on both side walls of the main winding section 130 of the preformed winding 104. Such dual gaps may require the core 102 to be fabricated in two pieces instead of one such that the gap 128 extends entirely across the core 102 from side wall 116 to side wall 114 of the core 102. The second core piece would then overly the main winding section 130 of the preformed winding 104 and the core piece 102.

Advantages of the gap 128 being filled with the magnetic material 150, as opposed to being a non-magnetic air gap or being otherwise filled with a non-magnetic material, include the following.

Fringing field loss is reduced for a given gap thickness t by filling the gap 128 with the material 150.

The gap thickness t can be higher for a given fringing field while simplifying manufacturing processes.

The magnetic material 150 makes it easier to form or assemble cores with higher gap sizes.

Electromagnetic interference of the component 100 with neighboring components may be reduced.

Inductance values of the completed component 100 may be varied by varying the magnetic permeability of the magnetic materials utilized, including inductance values that cannot easily be provided in a component having a non-magnetic gap.

Although the magnetic material 150 utilized can be provided in powder form, variations are possible using other forms. For example, the magnetic material 150 filling the gap 128 may be provided in liquid form or solid form in a known ribbon or tape configuration. In liquid or semisolid form, the magnetic material 150 can be applied to the gap 128 via basic potting methods or by injection or transfer molding techniques. In general, the component 100 including the material 150 in the gap is easily manufacturable with high productivity and reduced cost.

To make the magnetic mixture in liquid form, resins that are liquid at room temperature or that are liquid at a desired operating temperature of injection molding operations (preferably below 100° C. in contemplated embodiments) may be utilized, such that the resin only melts and does not crosslink during flow through channels in the injection mold.

Exemplary magnetic materials and polymers for the magnetic material 150 include polycrystalline or amorphous magnetic powders or their combinations for magnetic materials. Particle sizes may vary within a wide range of about 2 μm to about 200 μm in contemplated examples. The shapes of the magnetic particles may also vary in contemplated examples. Spherical shapes, rod shapes, and random shapes, among others, are possible. The magnetic powder materials may include ferrite, iron based alloys, cobalt based alloys, or other magnetic materials familiar to those in the art.

Exemplary polymer for mixing with the magnetic powder materials include thermosetting polymers such as epoxy or novolac, thermoplastic polymers, combinations of thermosetting and thermoplastic materials, and other equivalent materials familiar to those in the art. Polymers may be provided in solid, liquid, and/or semisolid form in various examples.

As those in the art will appreciate, the processing conditions to cure the component 100 will range depending on the particular polymer(s) utilized and their respective complete crosslinking attributes.

Figure 4:
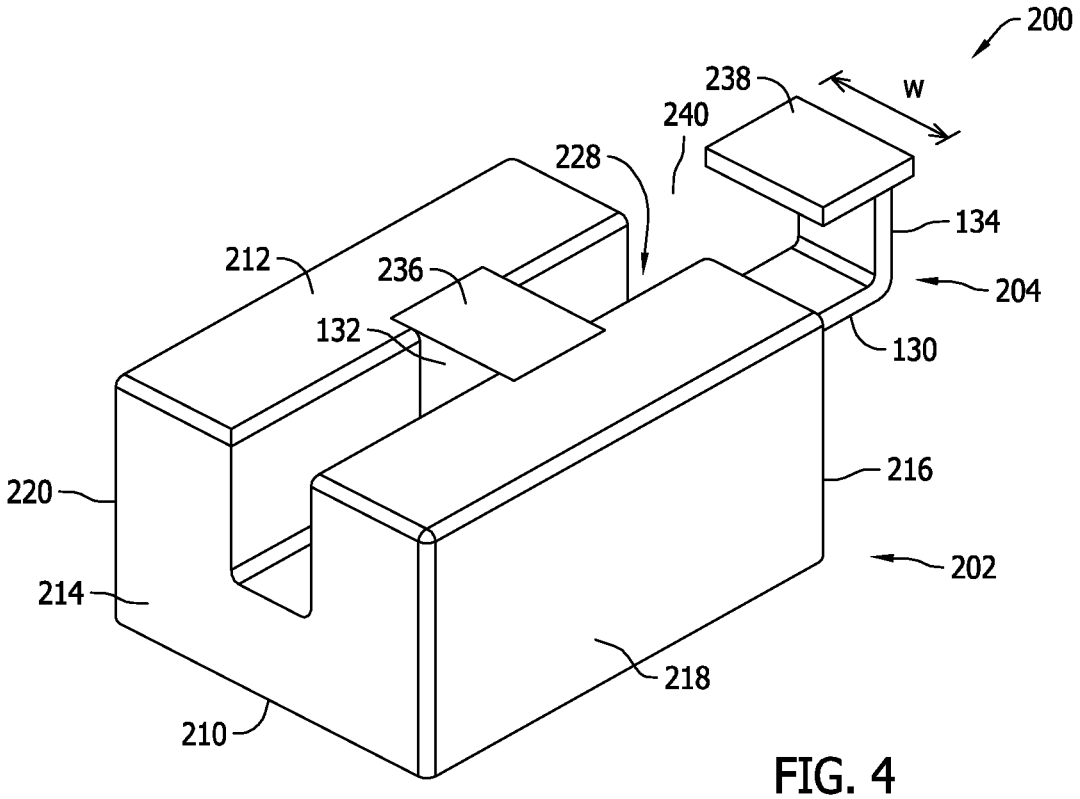
FIG. 4 is a bottom perspective view of a second exemplary embodiment of a surface mount magnetic component at a first stage of manufacture.
Figure 5:
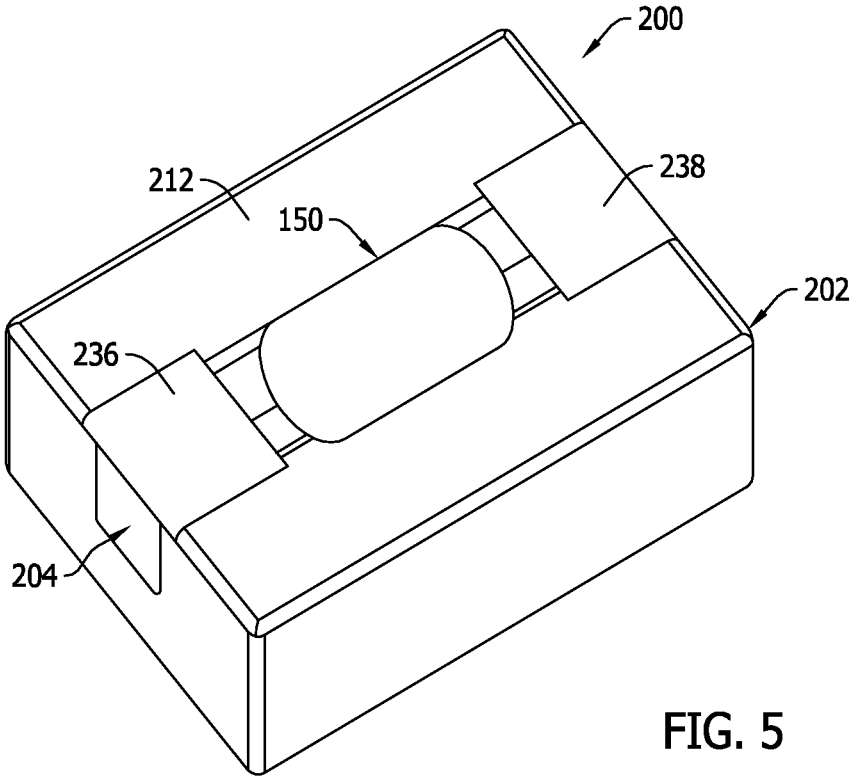
FIG. 5 is another bottom perspective view of the surface mount magnetic component shown in FIG. 4 at a second stage of manufacture.

FIGS. 4 and 5 illustrate another exemplary embodiment of a magnetic component 200 including a single piece magnetic core 202 and a preformed conductive winding 204.

The magnetic core 202 in the example of FIGS. 4 and 5 includes a generally rectangular body having orthogonal side walls including opposing top and bottom side walls 210, 212, opposing lateral side walls 214, 216 interconnecting the top and bottom side walls 210, 212, and opposing longitudinal side walls 218, 220 interconnecting the top and bottom side walls 210, 212 and the lateral side walls 214, 216. Unlike the core 102 (FIGS. 1-3 having the bottom side wall 112 formed with a projecting guide surface 122) all of the side walls 210, 212, 214, 216, 218 and 220 are generally flat and planar in the exemplary embodiment shown.

The magnetic core 202 is further formed with a gap 228 that extends to and through the lateral side walls 214, 216 and open to the bottom side wall 212. The gap 228 does not extend to either longitudinal side wall 218, 220, and does not extend to the top side wall 210 either. Rather, the gap 228 extends straight though the center of the bottom side wall 212 in a direction perpendicular to the lateral side walls 214 and 216 and in a direction perpendicular to the top and bottom side walls 210, 212. The gap 228 extends longitudinally through the core 202, and has a depth that imparts an overall U-shaped cross section or profile to the core 202. The shape of the core 202 is therefore simpler and easier to shape than the core 102 (FIGS. 1-3).

The preformed conductive winding 204, like the preformed winding 104 (FIGS. 1-3) includes the flat and planar main winding section 130, and opposing terminal sections 132, 134 extending generally perpendicular to the plane of the main winding section 130. Unlike the preformed winding 104, the preformed winding 204 includes enlarged surface mount terminal portions or sections 236, 238 extending inwardly from the terminal sections 132, 134 in a spaced relation from, but generally parallel to, the main winding section 130. More specifically, the enlarged surface mount terminal sections 236, 238 have a wider width w than the main winding section 130 and also the gap 228 in the core 202. A gap 240 also extends between the distal ends of the surface mount terminal sections 236, 238 of the preformed winding. The preformed winding 204 is fabricated as a separately provided part from the core 202 and is provided as a freestanding structure for assembly with the core 202 as described below.

As shown in FIG. 4, the preformed conductive winding 204 is assembled to the core 202 by inserting the main winding section 130 of the preformed winding 204 in the core gap 228 until the enlarged surface mount terminal portions 236, 238 abut the bottom side wall 212 of the core 202. The wider surface mount terminal portions 236, 238 effectively creates overhanging ledges that seat upon the bottom side wall 212 as the preformed winding 204 is installed. The winding 204 may therefore be slidingly assembled with the core 202 as shown in FIG. 4 until the main winding section 130 reaches the end of the gap 228. Such sliding assembly of a preformed winding 204 to the core 202 beneficially avoids more complicated manufacturing steps, and also associated issues discussed above relating to inserting a conductor through a through-hole and bending the ends of the conductor around the side walls of the core to complete the surface mount terminations.

As shown in FIG. 5, after assembly of the preformed winding 204, the gap 228 in the core 202 is filled with a magnetic material 150 to provide enhanced magnetic performance. When filled with a magnetic material 150, the gap 228, which otherwise would be non-magnetic, becomes a magnetic gap that provides for improved magnetic performance of the device 200.

The magnetic materials for fabricating the core 202 and the material 150 are the same as those discussed above. Except for a slightly easier assembly, the component 200 has comparable benefits to those described above in relation to the component 100.

Figure 6:
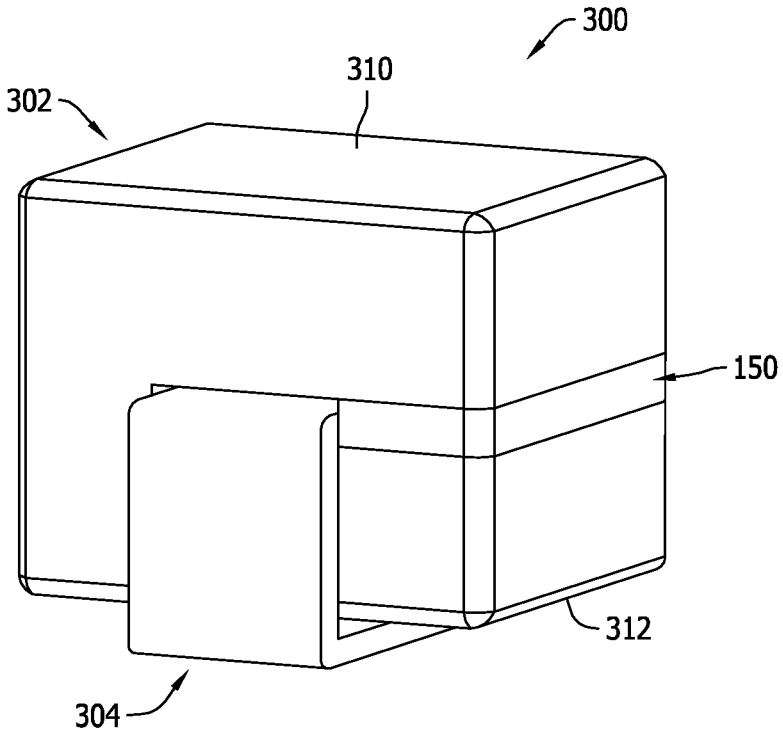
FIG. 6 is a side perspective view of a third exemplary embodiment of a surface mount magnetic component.

FIG. 6 illustrates a third exemplary embodiment of a magnetic component 300. The component 300 is similar to the component 100 (FIGS. 1-3) but has a simpler shaped core 302. Unlike the core 102, the core 302 has a bottom side wall 312 that is flat. In other words, the bottom side wall 312 does not include the guide surface 122 of the bottom side wall 112 in the core 102.

The magnetic materials for fabricating the core 302 and the material 150 are the same as those discussed above. Except for a slightly easier assembly, the component 300 has comparable benefits to those described above in relation to the component 100.

The components 100, 200, 300 define power inductors in contemplated embodiments. The power inductors 100, 200, 300 may be used in single phase, two phase, three phase and other multi-phase power management applications. When the components are mounted to a circuit board using the surface mount terminations of the preformed windings described, the components 100, 200, 300 are operable with reduced fringing losses in comparison to conventional power inductor devices having a non-magnetic air gap.

The benefits of the inventive concepts disclosed are now believed to have been amply illustrated in view of the exemplary embodiments disclosed.

An embodiment of a surface mount magnetic component assembly has been disclosed including: a magnetic core fabricated from a first magnetic material, the magnetic core having at least one gap formed therein; a conductive winding extending through the at least one gap, and a second magnetic material, separately provided from the magnetic core, filling the gap.

Optionally, the first magnetic material may be a ferrite material and the second magnetic material may be a non-ferrite material. The ferrite material may include ferrite particles mixed with a polymer to form a distributed gap material. The second magnetic material may include metal particles mixed with a polymer to form a distributed gap material.

As further options, the magnetic core may be a single piece core and the conductive winding may be a preformed winding. The magnetic core may include opposed top and bottom side walls and opposing lateral side walls, and the gap may extend partially between the opposing lateral side walls. The magnetic core piece may also have opposing longitudinal side walls, and the gap may extend to the longitudinal side walls. The gap may extend parallel to the top side wall, or the gap may extend perpendicularly to the top side wall. The gap may be open to the bottom side wall. The magnetic core may have a U-shaped cross section, or a T-shaped cross section. The conductive winding may be preformed and separately provided from the magnetic core.

The conductive winding may have a main winding section, terminal sections extending perpendicularly to the main winding section, and surface mount terminal sections extending perpendicularly to the main winding section. The gap may have a thickness, with the gap thickness being greater than a thickness of the main winding section, whereby the main winding section can be slidably inserted into the gap. The gap may have a width, and at least one of the surface mount terminal sections may have a width greater than the gap width. The assembly may define a power inductor.

Another embodiment of a surface mount magnetic component has been disclosed. The component includes: a single magnetic core piece fabricated from a first magnetic material comprising first magnetic powder particles mixed with a polymer, the single magnetic core piece having a gap formed therein; a conductive winding comprising a main winding and surface mount sections, the main winding section extending through the gap, and a second magnetic material filling the gap, the second magnetic material separately provided from the magnetic core and a having second magnetic powder particles mixed with a polymer; wherein one of the magnetic powder materials in the first and second magnetic materials comprises ferrite particles and the other of the magnetic powder materials in the first and second magnetic powder materials comprises non-ferrite particles.

Optionally, the single magnetic core piece may have a U-shape or a T-shape. The conductive winding may be preformed from the single magnetic core piece. The assembly may define a power inductor.

An embodiment of a surface mount magnetic component assembly has also been disclosed including: a single magnetic core piece fabricated from a first magnetic material comprising first magnetic powder particles mixed with a polymer, the single magnetic core piece having a gap formed therein; a preformed conductive winding comprising a main winding section extending through the gap and opposed terminal sections extending perpendicular to the main winding section, the opposed terminal sections extending externally to the single magnetic core piece, and a second magnetic material filling the gap, the second magnetic material separately provided from the magnetic core and a having second magnetic powder particles mixed with a polymer; wherein one of the magnetic powder materials in the first and second magnetic materials comprises ferrite particles and the other of the magnetic powder materials in the first and second magnetic powder materials comprises non-ferrite particles; and wherein the assembly defines a power inductor.

An embodiment of a surface mount magnetic component assembly has been disclosed comprising: a magnetic core fabricated from a first magnetic material, the magnetic core having at least one gap formed therein; a conductive winding extending through the at least one gap; and a second magnetic material, separately provided from the magnetic core, filling the gap.

Optionally, the first magnetic material may be a ferrite material and the second magnetic material comprises a non-ferrite material. The ferrite material may include ferrite particles mixed with a polymer to form a distributed gap material. The second magnetic material may also include metal particles mixed with a polymer to form a distributed gap material.

The magnetic core may be a single piece core and the conductive winding may be a preformed winding. The magnetic core may include opposed top and bottom side walls and opposing lateral side walls, and the gap may extend partially between the opposing lateral side walls. The magnetic core piece may also include opposing longitudinal side walls, and the gap may extend to the longitudinal side walls. The gap may extend parallel to the top side wall, or the gap may extend perpendicularly to the top side wall. The gap may be open to the bottom side wall. The magnetic core may have a U-shaped cross section. The magnetic core may also have a T-shaped cross section.

The conductive winding may be preformed and separately provided from the magnetic core. The conductive winding may include a main winding section, terminal sections extending perpendicularly to the main winding section, and surface mount terminal sections extending perpendicularly to the main winding section. The gap may have a thickness, with the gap thickness being greater than a thickness of the main winding section, whereby the main winding section can be slidably inserted into the gap. The gap may also have a width, and at least one of the surface mount terminal sections may have a width greater than the gap width. The assembly may define a power inductor.

An embodiment of a surface mount magnetic component assembly has also been disclosed including: a single magnetic core piece fabricated from a first magnetic material comprising first magnetic powder particles mixed with a polymer, the single magnetic core piece having a gap formed therein; a conductive winding comprising a main winding section and surface mount terminal sections, the main winding section extending through the gap; and a second magnetic material filling the gap, the second magnetic material separately provided from the magnetic core and a having second magnetic powder particles mixed with a polymer; wherein one of the magnetic powder materials in the first and second magnetic materials comprises ferrite particles and the other of the magnetic powder materials in the first and second magnetic powder materials comprises non-ferrite particles.

Optionally, the single magnetic core piece may have a U-shape. The single magnetic core piece may also have a T-shape. The conductive winding may be preformed from the single magnetic core piece. The assembly may define a power inductor.

An embodiment of a surface mount magnetic component assembly has also been disclosed including: a single magnetic core piece fabricated from a first magnetic material comprising first magnetic powder particles mixed with a polymer, the single magnetic core piece having a gap formed therein; a preformed conductive winding comprising a main winding section extending through the gap and opposed terminal sections extending perpendicular to the main winding section, the opposed terminal sections extending externally to the single magnetic core piece; and a second magnetic material filling the gap, the second magnetic material separately provided from the magnetic core and a having second magnetic powder particles mixed with a polymer; wherein one of the magnetic powder materials in the first and second magnetic materials comprises ferrite particles and the other of the magnetic powder materials in the first and second magnetic powder materials comprises non-ferrite particles; and wherein the assembly defines a power inductor.

An embodiment of a surface mount magnetic component assembly has also been disclosed including: a magnetic core fabricated as a single piece from a first magnetic material, the magnetic core having opposed top and bottom side walls and at least one non-magnetic gap formed therein and extending between the opposed top and bottom side walls; a conductive winding extending through the at least one non-magnetic gap; and a second magnetic material, separately provided from the magnetic core, applied to the non-magnetic gap.

Optionally, the second magnetic material may be applied to the non-magnetic gap in one of a liquid form, a semisolid form, or solid form. The second magnetic material may be applied to the non-magnetic gap in one of a ribbon or tape configuration. At least a portion of the magnetic core may have a U-shaped cross section. At least a portion of the single magnetic core piece may have a T-shaped cross section. The conductive winding may be preformed from the single magnetic core piece. The assembly may define a power inductor.

The magnetic core may further include opposing lateral side walls, wherein the non-magnetic gap extends partially between the opposing lateral side walls. The magnetic core may also further include opposing longitudinal side walls, wherein the non-magnetic gap extends to the longitudinal side walls. The non-magnetic gap may extend parallel to the top side wall, or may extend perpendicularly to the top side wall. The non-magnetic gap may be open to the bottom side wall.

The conductive winding may have a main winding section, terminal sections extending perpendicularly to the main winding section, and surface mount terminal sections extending perpendicularly to the main winding section. The non-magnetic gap may have a thickness, with the gap thickness being greater than a thickness of the main winding section, whereby the main winding section can be slidably inserted into the non-magnetic gap. The non-magnetic gap may also have a width, and at least one of the surface mount terminal sections may have a width greater than the gap width.

The second magnetic material may have different magnetic properties than the first magnetic material. The bottom side wall of the magnetic core may be flat. Alternatively, the bottom side wall includes a projecting guide surface.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A surface mount magnetic component assembly consisting of:

a magnetic core consisting of only one core piece fabricated from a first magnetic material into a body having opposed top and bottom walls and opposed first and second walls extending between the top and bottom walls, the magnetic core having at least one gap formed therein and extending only partially between the opposed first and second walls;

a conductive winding extending through the at least one gap; and a second magnetic material, separately provided from the magnetic core, filling the at least one gap and cured in place.

2. The surface mount magnetic component assembly of claim 1, wherein the first magnetic material is a ferrite material and the second magnetic material is a non-ferrite material.

3. The surface mount magnetic component assembly of claim 2, wherein the ferrite material is ferrite particles mixed with a polymer to form a distributed gap material.

4. The surface mount magnetic component assembly of claim 2, wherein the second magnetic material is metal particles mixed with a polymer to form a distributed gap material.

5. The surface mount magnetic component assembly of claim 1, wherein the conductive winding is a preformed winding.

6. The surface mount magnetic component assembly of claim 1, wherein the magnetic core includes opposing lateral side walls and opposing longitudinal side walls, and wherein the gap extends only partially between the opposing lateral side walls.

7. The surface mount magnetic component assembly of claim 1, wherein the magnetic core further includes opposing lateral side walls and opposing longitudinal side walls, and wherein the gap extends only partially between the longitudinal side walls.

8. The surface mount magnetic component assembly of claim 1, wherein the gap extends parallel to the top side wall.

9. The surface mount magnetic component assembly of claim 1, wherein the gap extends perpendicularly to the top side wall.

10. The surface mount magnetic component assembly of claim 1, wherein the gap is open to the bottom side wall.

11. The surface mount magnetic component assembly of claim 1, wherein the only one core piece has a U-shaped cross section.

12. The surface mount magnetic component assembly of claim 6, wherein the only one core piece has a T-shaped cross section.

13. The surface mount magnetic component assembly of claim 1, wherein the conductive winding is preformed and separately provided from the magnetic core.

14. The surface mount magnetic component assembly of claim 1, wherein the conductive winding has a main winding section, terminal sections extending perpendicularly to the main winding section, and surface mount terminal sections extending parallel to the main winding section.

15. The surface mount magnetic component assembly of claim 14, wherein the gap has a thickness, the gap thickness being greater than a thickness of the main winding section to accommodate a slidable insertion of the main winding section into the gap.

16. The surface mount magnetic component assembly of claim 14, wherein the gap has a width, and at least one of the surface mount terminal sections has a width greater than the gap width.

17. The surface mount magnetic component assembly of claim 1, wherein the assembly defines a power inductor.

18. A surface mount magnetic component assembly consisting of:

only one preformed magnetic core piece fabricated from first magnetic powder particles mixed with a polymer, the only one core piece having a gap formed therein;

a conductive winding defined by a main winding section and surface mount terminal sections, the main winding section extending through the gap; and a second magnetic material filling the gap, the second magnetic material separately provided from the only one preformed magnetic core piece and fabricated from second magnetic powder particles mixed with a polymer that is cured in place adjacent the winding in the gap;

wherein the first magnetic materials are ferrite particles and the second magnetic powder materials are non-ferrite particles.

19. The surface mount magnetic component assembly of claim 18 wherein the only one preformed magnetic core piece has a U-shape.

20. The surface mount magnetic component assembly of claim 18 wherein the only one preformed magnetic core piece has a T-shape.

21. The surface mount magnetic component assembly of claim 18, wherein the conductive winding is preformed from the only one preformed magnetic core piece.

22. The surface mount magnetic component assembly of claim 18, wherein the assembly defines a power inductor.

23. A surface mount magnetic component assembly consisting of:

only one preformed magnetic core piece fabricated from first magnetic powder particles mixed with a polymer, the only one preformed magnetic core piece having a gap formed therein;

a preformed conductive winding with a main winding section extending through the gap and with opposed terminal sections extending perpendicularly to the main winding section, the opposed terminal sections extending externally to the only one preformed magnetic core piece; and a second magnetic material filling the gap, the second magnetic material separately provided from the only one preformed magnetic core and having second magnetic powder particles mixed with a polymer that is cured in place in the gap;

wherein the first and second magnetic powder particles are ferrite particles and wherein the other of the first and second magnetic powder materials are non-ferrite particles; and wherein the assembly defines a power inductor.

24. A surface mount magnetic component assembly consisting of:

a magnetic core consisting of only one magnetic core piece fabricated from a first magnetic material, the only one magnetic core piece having opposed top and bottom walls and at least one non-magnetic gap formed therein and extending between the opposed top and bottom side walls;

a preformed conductive winding including a planar section extending through the at least one non-magnetic gap; and a second magnetic material, separately provided from the only one magnetic core piece, applied to the non-magnetic gap and cured in place.

25. The surface mount magnetic component assembly of claim 24, wherein the second magnetic material is applied to the non-magnetic gap in one of a liquid form, a semisolid form, or solid form.

26. The surface mount magnetic component assembly of claim 24, wherein the second magnetic material is applied to the non-magnetic gap in one of a ribbon or tape configuration.

27. The surface mount magnetic component assembly of claim 24, wherein at least a portion of the magnetic core has a U-shaped cross section.

28. The surface mount magnetic component assembly of claim 24, wherein at least a portion of the single magnetic core piece has a T-shaped cross section.

29. The surface mount magnetic component assembly of claim 24, wherein the assembly defines a power inductor.

30. The surface mount magnetic component assembly of claim 24, wherein the magnetic core further includes opposing lateral side walls, and wherein the non-magnetic gap extends partially between the opposing lateral side walls.

31. The surface mount magnetic component assembly of claim 24, wherein the magnetic core further includes opposing longitudinal side walls, and wherein the non-magnetic gap extends to the longitudinal side walls.

32. The surface mount magnetic component assembly of claim 24, wherein the non-magnetic gap extends parallel to the top side wall.

33. The surface mount magnetic component assembly of claim 24, wherein the non-magnetic gap extends perpendicularly to the top side wall.

34. The surface mount magnetic component assembly of claim 24, wherein the non-magnetic gap is open to the bottom side wall.

35. The surface mount magnetic component assembly of claim 24, wherein the conductive winding has a main winding section, terminal sections extending perpendicularly to the main winding section, and surface mount terminal sections extending parallel to the main winding section.

36. The surface mount magnetic component assembly of claim 35, wherein the non-magnetic gap has a thickness, the gap thickness being greater than a thickness of the main winding section, whereby the main winding section can be slidably inserted into the non-magnetic gap.

37. The surface mount magnetic component assembly of claim 35, wherein the non-magnetic gap has a width, and at least one of the surface mount terminal sections has a width greater than the gap width.

38. The surface mount magnetic component assembly of claim 24, wherein the second magnetic material has different magnetic properties than the first magnetic material.

39. The surface mount magnetic component assembly of claim 24, wherein the bottom side wall of the magnetic core is flat.

40. The surface mount magnetic component assembly of claim 24, wherein the bottom side wall includes a projecting guide surface.

* * * * *